United States Patent [19]

Lembcke et al.

[11] Patent Number: 4,811,792

[45] Date of Patent: Mar. 14, 1989

[54] WELL TOOL STABILIZER AND METHOD

[75] Inventors: Jeffrey J. Lembcke; Brian Shaw, both of Broken Arrow, Okla.

[73] Assignee: Baker Hughes Incorporated, Houston, Tex.

[21] Appl. No.: 164,867

[22] Filed: Mar. 7, 1988

[51] Int. Cl.[4] ..... E21B 17/10; E21B 23/00

[52] U.S. Cl. ..... 166/381; 33/178 F; 166/64; 166/241

[58] Field of Search ..... 166/241, 64, 250, 253–255, 166/113, 381, 382; 175/325; 33/178 F

[56] References Cited

U.S. PATENT DOCUMENTS

| | | | |
|---|---|---|---|
| 2,964,110 | 12/1960 | Garwood et al. | 166/241 |
| 3,087,552 | 4/1963 | Graham | 166/241 X |
| 3,978,924 | 9/1976 | Roesner | 166/241 |
| 4,523,640 | 6/1985 | Wilson et al. | 166/241 X |
| 4,557,327 | 12/1985 | Kinley et al. | 166/241 |
| 4,615,386 | 10/1986 | Briscoe | 166/241 |
| 4,619,322 | 10/1986 | Armell et al. | 166/241 |

FOREIGN PATENT DOCUMENTS 2173533 10/1986 United Kingdom .

*Primary Examiner*—Stephen J. Novosad

*Attorney, Agent, or Firm*—Hubbard, Thurman, Turner & Tucker

[57] ABSTRACT

A mechanism for accurately positioning a well tool in axially concentric relationship to a well conduit comprises a housing having a plurality of peripherally spaced vertically extending slots therein. A stabilizer linkage is mounted in each slot, with one end of the linkage being pivotally secured in the slot and the other end free to move in an axial direction. Axially spaced anti-friction elements are carried on the linkage and are movable radially into engagement with the casing wall by axial movement of the other end of the stabilizer linkage. The other end of the stabilizer linkage is pivotally secured to a sleeve which is sealably and slidably mounted within the housing and defines a trapped fluid chamber which acts as a dashpot to delay radial expansion movement of the stabilizer linkage. A check valve cooperating with the trapped fluid chamber permits rapid radially retracting movement of the stabilizer linkage to permit the anti-friction elements to pass through restrictions in the well conduit during withdrawal of the tool.

10 Claims, 3 Drawing Sheets

WELL TOOL STABILIZER AND METHOD

This application is related to application Ser. No. 164,866, filed concurrently herewith and assigned to the assignee of this application.

BACKGROUND OF THE INVENTION

1. Field of the Invention:

The invention relates to a mechanism for stabilizing a well tool in axially concentric relationship to the bore of a well conduit.

2. Summary of the Prior Art:

So-called centralizers have long been employed in subterranean wells for positioning a well tool in concentric relationship to the bore of a well conduit. Normally, such stabilizers take the form of a plurality of peripherally spaced, radially outwardly extending leaf spring elements which frictionally engage the bore of the well conduit. With this type of construction, the centralizer necessarily must be in frictional engagement with the well conduit both during run-in and during retrieval of the tool from the well conduit. Such friction not only produces undesirable wear on the centralizer but also on the bore wall of the conduit. Moreover, the speed of run-in or withdrawal is necessarily detrimentally affected.

U.K. Patent Application No. 2173533A discloses a stabilizer system employing radially expandable linkages each of which carries a roller on its radially outermost portions. The linkage is constantly spring urged to a radially expanded position and the rollers are thus in constant rolling engagement with the bore wall of the well conduit.

In recent years, a system has been developed for controlling downhole safety valves by electromagnetic waves radiated by a surface transmitter. Such system requires that a rod-like antenna be accurately centered in the well conduit at a position adjacent the electromagnetic wave receiving apparatus. If such antenna vibrates due to fluid flow around the antenna housing, the signal reception is subject to undesirable noise which may result in an erroneous signal transmittal to the safety valve control apparatus. It has been found that a more efficient and reliable stabilizer system is required by the aforementioned electromagnetic wave responsive control system than has been available in the prior art.

SUMMARY OF THE INVENTION

This invention provides a stabilizing mechanism for a well tool comprising a tubular housing having a plurality of peripherally spaced vertically extending slots formed in the wall thereof. A stabilizing linkage is mounted in each slot and one end of such linkage is pivotally secured in one end of the respective slot. The other end of each linkage is pivotally secured to an actuator sleeve which is slidably and sealably mounted within the bore of the housing. The linkage is configured to produce a radially outward, concurrent expansion of two axially spaced pivot arms while the linkage is being expanded by axial movement of the sleeve secured end of the linkage. Anti-friction means, preferably comprising axially spaced rollers, are mounted on the free ends of the aforementioned pivot arms and concurrently engage the bore wall of the well conduit into which the tool is inserted. The axial spacing of the rollers permits the stabilizing device to pass threaded joints and annular grooves in the bore wall of the conduit without substantially changing the axial position of the tool carrying the stabilizing device, since the axial spacing of the rollers permits only one roller to engage the groove or an inwardly projecting obstruction at a time.

To permit the ready insertion of the stabilizing tool and stabilizing device into the well conduit, a fusible bolt is provided for the stabilizing linkages which secures each linkage in a contracted position in the housing during run-in and for a short period after run-in, sufficient to permit the fusible bolt to reach a melting temperature from the higher temperature ambient of the well at the depth to which the tool is inserted. Thus, there is no frictional engagement between the stabilizing device and the bore wall of the conduit during run-in. Upon melting of the fusible bolt, the stabilizing linkages move radially outwardly to engage the conduit wall under the axial bias of a compressed spring operating on the axially movable sleeve. To prevent an impact engagement of the stabilizing rollers with the bore wall of the conduit, the sleeve cooperates with the bore wall of the housing to define a trapped fluid chamber which prevents rapid axial movement of the sleeve in the linkage expansion direction. The rate of axial movement of the sleeve is controlled by an orifice passage permitting the discharge of fluid from the trapping chamber to a second chamber at a controlled rate.

When it is necessary to remove the tool from the well, it is, of course, desirable that the stabilizer device rapidly adjust itself in a radial direction to accommodate passage of the bore wall engaging rollers through internal restrictions found in the bore wall of a well conduit. Rapid radial movement of the stabilizing linkages in an inward direction is permitted by a check valve in the second chamber receiving fluid from the trapped fluid chamber to permit the rapid transfer of fluid which accumulated in such chamber during the radially outward movement of the stabilizing linkages to the trapping chamber. Thus, the stabilizing linkages can be readily deflected in an inward direction to accommodate passages over internal conduit wall obstructions.

Further advantages of the invention will be readily apparent to those in the art from the following detailed description, taken in conjunction with the annexed sheets of drawings, on which is shown a preferred embodiment of the invention.

DESCRIPTION OF PREFERRED EMBODIMENT

One application of a stabilizing mechanism embodying this invention is in conjunction with the stabilization of a downhole antenna for receiving electromagnetic wave signals from a surface transmitter, in order to effect the operation of a safety valve. Such overall system is schematically shown in FIG. 1.

Figure 1:
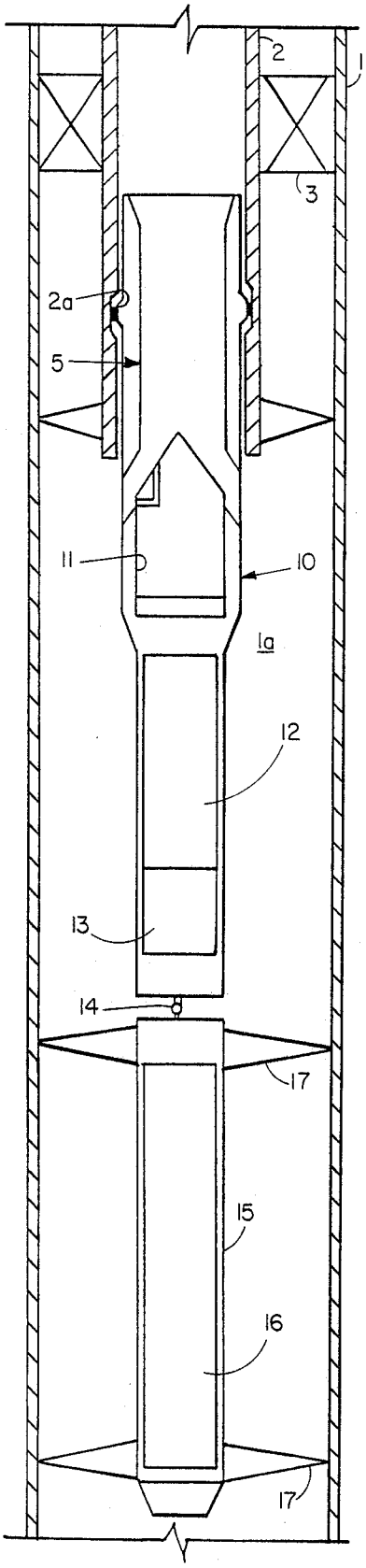
FIG. 1 is a schematic vertical sectional view of a well tool incorporating a pair of stabilizing devices embodying this invention.

Thus, referring first to the schematic view of FIG. 1, a safety valve 10 is shown installed in the bottom end of production tubing 2 which is run into a well casing 1 and the annulus 1a between the production tubing 2 and the well casing 1 is sealed by a conventional packer 3. The safety valve 10 may be suspended in the bottom end of the tubing string 2 by any type of conventional locking mechanism 5 which cooperates with an internal recess 2a formed in the production tubing 2.

Safety valve 10 incorporates a safety valve mechanism 11, a battery case 12, and an electronic signal converter unit 13. An antenna housing 15 is flexibly connected to the bottom end of the safety valve housing by a conventional flex joint 14 and houses an antenna 16. The antenna housing 15 is maintained in a fixed axially aligned position relative to the axis of casing 1 by a pair of stabilizing units 17 respectively mounted at either end of the antenna housing 15.

With the exception of the stabilizing unit 17, the details of the aforementioned structures are fully disclosed in the above referred to co-pending application, and form no part of this invention, which is directed to the construction of the stabilizing units 17.

Figure 2A:
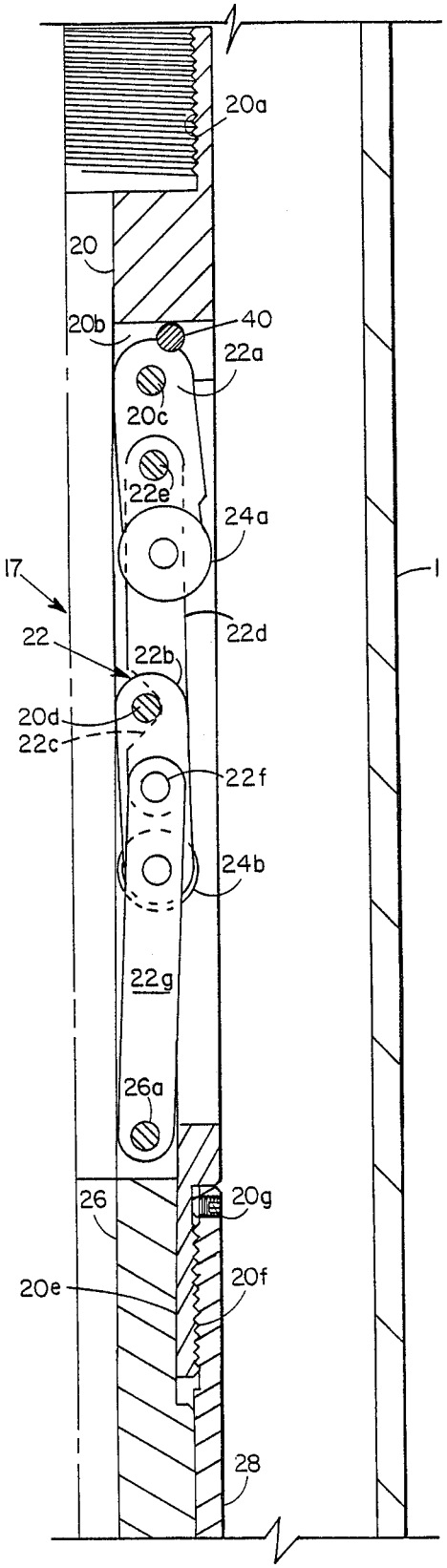
FIGS. 2A and 2B collectively constitute a vertical quarter sectional view of a stabilizing device embodying this invention with the components of the device shown in their run-in positions.
Figure 2B:
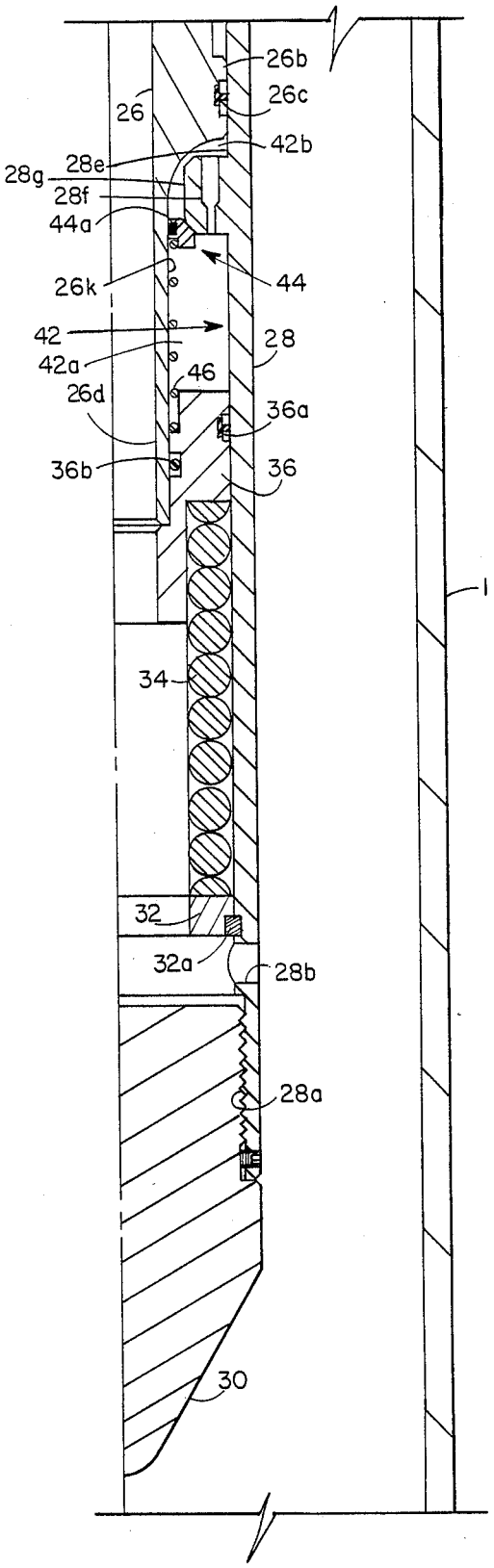

Referring now to FIGS. 2A and 2B, it will be observed that each stabilizing unit 17 is carried by a tubular housing 20 which is provided at its upper end with internal threads 20a for engagement with the bottom of the tool string previously described. Housing 20 is further provided with a plurality of peripherally spaced, vertically extending slots 20b. Each slot receives a radially expandable linkage 22 comprising a pair of pivot arms 22a and 22b which are respectively pivotally mounted in the slots 20b by transverse pivot pins 20c and 20d.

The medial portions of the pivot arms 22a and 22b are pivotally interconnected by a longitudinally extending link 22d which is secured to the pivot arms 22a and 22b by pivot pins 22e and 22f. The free ends of the links 22a and 22b respectively mount anti-friction devices, such as rollers 24a and 24b.

An expansion link 22g is secured at one end to the pivot pins 22f and at the other end is pivotally secured to an axially shiftable actuator sleeve 26 by pivot pin 26a.

Accordingly, when the actuator sleeve 26 is disposed in a downward position relative to the radially expansible linkage 22, the linkage is retracted to the position shown in FIG. 2A wherein all components of the linkage lie within the periphery of the housing 20, and thus offer no opportunity for damaging contact with the conduit walls as the stabilizer unit 17 is run into the well. A notch 22c in link 22d clears pivot pin 20d in this position.

The stabilizer linkage 22 is radially expanded to engage the rollers 24a and 24b with the bore wall of the well conduit by upward movement of the actuating sleeve 26. Actuating sleeve 26 cooperates in sliding and sealable relationship with the bore 28e of the extension sleeve 28. An extension sleeve 28 is secured to external threads 20f provided on the lower end of the housing 20 to constitute, in effect, an extension of the housing 20. A set screw 20g secures the threads 20f. A radial enlargement 26b on actuator sleeve 26 mounts a T seal 26c which engages the bore 28e of the housing extension 28.

The bottom end of the extension sleeve 28 of the lowermost stabilizing unit 17 is provided with internal threads 28a for mounting a cone-shaped flow deflecting plug 30 thereto. A plurality of peripherally spaced ports 28b are provided in the bottom end of extension sleeve 28 to permit well fluids to freely enter the interior of the extension sleeve 28 and hence the bore 20e of the housing 20.

Figure 3A:
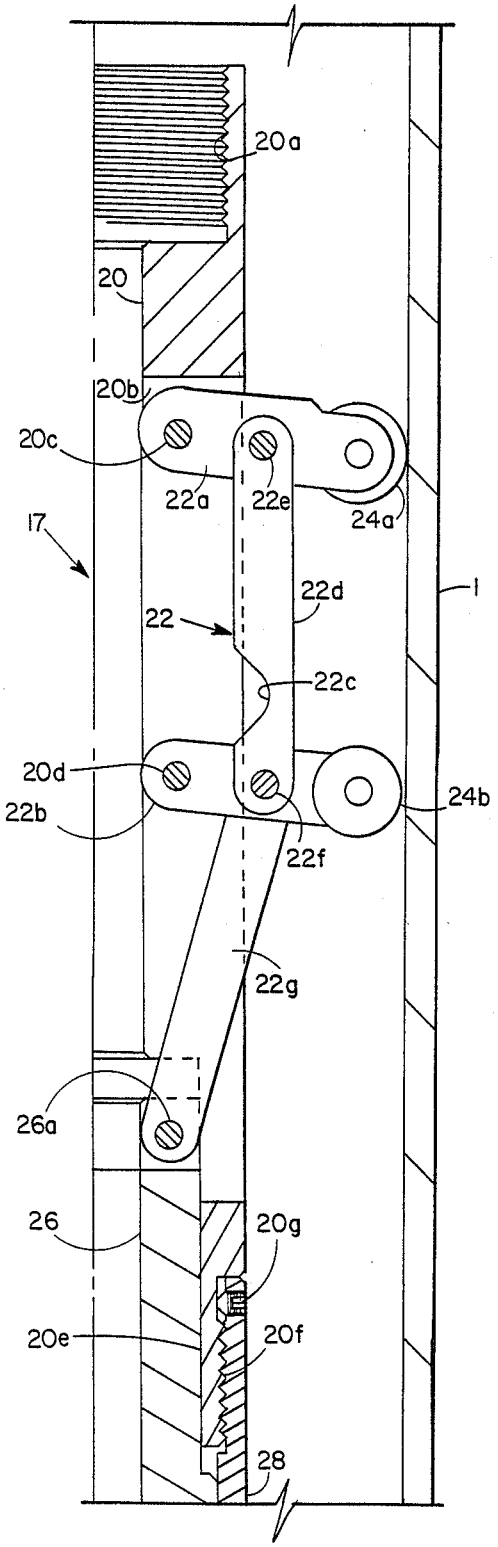
FIGS. 3A and 3B are views similar to FIGS. 2A but showing the components of the stabilizing device in their radially expanded position of engagement with the bore wall of the well conduit.
Figure 3B:
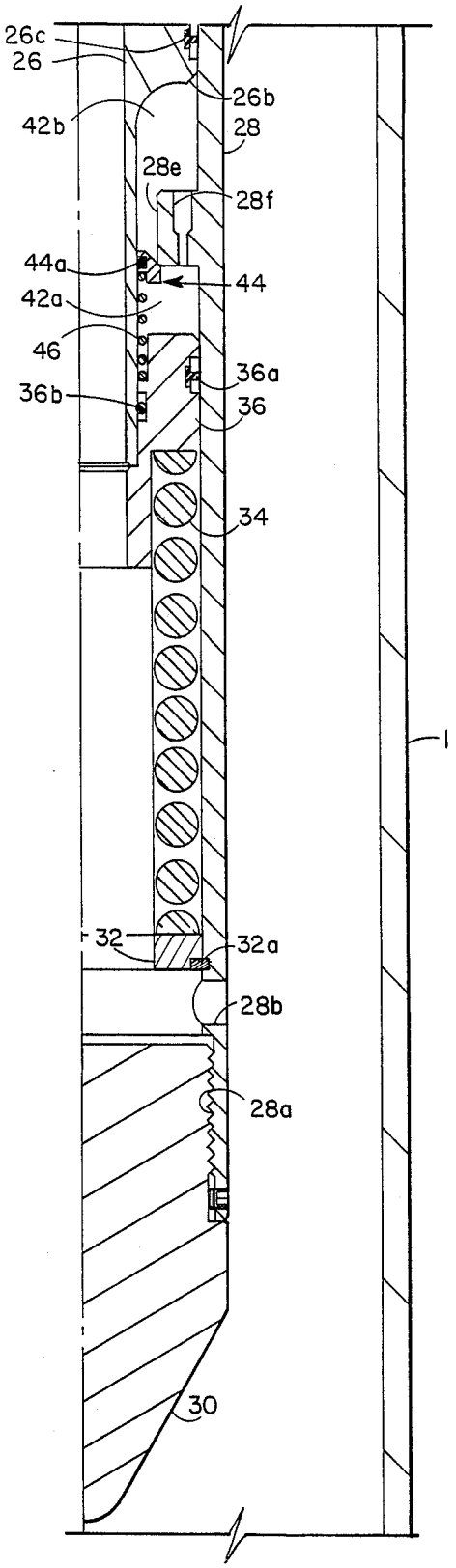

A spring anchor ring 32 is secured adjacent the bottom end of the extension sleeve 28 by snap ring 32a to provide a seat for an actuator spring 34. The top end of actuator spring 34 engages an annular spring seat 36 which is integral with or suitably sealably secured to the lower end of the actuating sleeve 26. Thus, when no restraints are imposed upon upward movement of the actuating sleeve 26, the spring 34 moves the actuator sleeve 26 upwardly causing the radially expansible stabilizer linkages 22 to move outwardly to the position shown in FIG. 3A where the anti-friction rollers 24a and 24b are in engagement with the bore wall of the well conduit.

To maintain the radially expansible stabilizer linkage 22 in a contracted position during run-in, a fusible bolt 40 abuts one of the links incorporated in the expansible linkage 22 and effectively secures all linkages 22 within the body of the housing 20. For example, fusible bolt 40 is shown as abutting pivot arm 22a. The melting point of fusible bolt 40 is selected to produce melting within a reasonable time, say ten to thirty minutes, after the fusible bolt is exposed to the ambient well temperatures existing at the location of the stabilizer linkage 22 in the well. Thus, during the entire run-in of the stabilizer linkage, the linkages 22 are in their retracted positions and do not move into engagement with the bore wall of the well conduit until the fusible bolt 40 has melted by exposure to the downhole well temperatures.

To prevent the expansible linkage 22 from rapidly expanding into engagement with the bore wall of the well conduit and thus possibly damaging the anti-friction roller elements 24a and 24b, a dashpot fluid chamber 42 is provided. The dashpot chamber 42 is defined between the seal elements 26c and the seals 36a and 36b on the spring seat ring 36 which is secured to the actuating sleeve 26. An internally projecting rib 28g is formed on extension sleeve 28 and lies within the dashpot chamber 42. The dashpot chamber 42 is filled with an appropriate fluid through a plugged fill port (not shown) formed in the internally projecting rib 28g.

A check valve 44 is provided comprising a ring mounting an O-ring 44a which is urged into sealing engagement between the lower end of the annular rib 28g and the adjacent external surface 26k of the actuating sleeve 26 by a light spring 46.

It will therefore be apparent that the dash pot chamber 42 in reality comprises two chambers 42a and 42b separated by the annular rib 28g and the check valve 44. A constricted orifice passage 28f is formed in the annular rib 28e to permit fluid to flow at a controlled rate from the lower chamber 42a into the upper chamber 42b. Thus, the upward movement of the actuator sleeve 26, and hence the radial expansion of the stabilizer linkage 22 will be controlled in accordance with the rate of fluid flow through the orifice passage 28f.

On the other hand, when the tool string is withdrawn from the well, it is quite common for the anti-friction rollers 24a and 24b to contact internal ribs or other constrictions formed on the bore wall of the well conduit. The anti-friction rollers 24a and 24b must be capable of rapid contraction movement in order to pass through such obstructions without damage. This is accomplished by the check valve 44. When either anti-friction roller 24*a* or 24*b* encounters an obstruction, a downward force is applied to the actuating sleeve 26. Such downward force will cause a compression of the trapped fluid contained in the upper chamber 42*b* and the increased fluid pressure in such chamber will cause the check valve 44 to open to permit rapid fluid flow into lower chamber 42*a* and permit free downward movement of the actuating sleeve 26, hence permitting free contracting movement of the stabilizer linkages 22.

The rollers 24*a* and 24*b* thus function to firmly and accurately hold the housing 20 in alignment with the axis of the well conduit, hence providing a stable anchor for the top and bottom ends of the antenna housing 15. If additional stabilization is required, then additional stabilizing units 17 can be incorporated in the tool string at spaced intervals, but generally the incorporation of a stabilizing unit 17 at both the top and bottom ends of the antenna housing 15 is adequate to maintain the antenna housing free of any vibration produced by the production fluid flowing past such housing.

It should also be mentioned that the provision of two vertically spaced anti-friction rollers 24*a* and 24*b* substantially diminishes the radial movement of the stabilizer linkage 22 as the tool string is withdrawn from the well. Obviously, only one of the anti-friction rollers can enter a casing joint recess at a time, and since such rollers are interconnected by essentially a parallelogram linkage, no movement of the linkage will occur when only one roller passes over a casing joint recess or other annular recesses conventionally found in the bore of a well conduit.

Those skilled in the art will recognize that the aforedescribed stabilizer system insures the accurate centering of an antenna or any other well tool in concentric relationship to the axis of a well conduit. Furthermore, the run-in of the stabilizing unit may be accomplished without any contact between the stabilizing linkage and the conduit wall, inasmuch as the stabilizing linkage never contacts the conduit wall until the fusible bolt 40 is melted by exposure to ambient well temperature at the final position of the stabilizing linkages 22 in the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A stabilizer housing for a well tool mounted in a cased subterranean well comprising, in combination:

a tubular body connectable in co-axially aligned series relationship to the well tool;

said tubular body having a plurality of peripherally spaced, longitudinal slots extending through the wall of said tubular body;

a radially expandable linkage disposed in each said longitudinal slot;

means for pivotally securing one end of each said linkage in one end of the respective longitudinal slot, whereby axial movement of the other end of each said linkage relative to said tubular body shifts said linkage from a radially contracted run-in position to a radially expanded position;

resilient means urging said other ends of said linkages to said radially expanded position;

anti-friction means carried by each said linkage engageable with the well casing wall in said radially expanded position;

releasable means for securing said linkages in said radially retracted position to permit run-in and positioning of the well tool prior to any radial expansion of said linkages;

said resilient means comprising a compression spring mounted within the bore of said tubular body;

means in the bore of said tubular body defining an abutment engaging one end of said compression spring;

a sleeve slidable in the bore of said tubular body and having means on said sleeve engagable with said compression spring; and means for pivotally connecting the other ends of said linkages to said sleeve, whereby said compression spring concurrently urges all of said linkages to said radially expanded positions.

2. The apparatus of claim 1 wherein said linkages lie within the periphery of said tubular body when secured in said radially retracted position.

3. The apparatus of claim 1 wherein each said linkage comprises a parallelogram arrangement of two pivot levers and a connecting link;

said anti-friction means comprises a pair of rollers mounted on the end of each said pivot levers in axially spaced relation;

said rollers being positioned on the respective linkage to lie radially equi-distant from the axis of said tubular body.

4. The apparatus of claim 1 or 3 further comprising dashpot means for controlling the rate of radial expansion of said anti-friction means by said resilient means.

5. A stabilizer housing for a well tool mounted in a cased subterranean well comprising, in combination:

a tubular body connectable in co-axially aligned series relationship to the well tool;

said tubular body having a plurality of peripherally spaced, longitudinal slots extending through the wall of said tubular body;

a radially expandable linkage disposed in each said longitudinal slot;

means for pivotally securing one end of each said linkage in one end of the respective longitudinal slot, whereby axial movement of the other end of each said linkage relative to said tubular body shifts said linkage from a radially expanded position;

a compression spring mounted within the bore of said tubular body;

means in the bore of said tubular body defining an abutment engaging one end of said compressions spring;

a sleeve slidable in the bore of said tubular body and having means on said sleeve engagable with said compression spring;

means for pivotally connecting the other ends of said linkages to said sleeve, whereby said compression spring concurrently urges all of said linkages to said radially expanded positions;

means on said sleeve cooperating with said bore of said tubular body to define a fluid containing chamber, the volume of said fluid containing chamber being decreased by axial movement of said sleeve produced by said compression spring;

orifice means for discharging fluid from said fluid containing chamber at a selected rate, thereby controlling rate of radial expansion of said linkages;

anti-fraction means carried by each said linkage engagable with the well casing wall in said radially expanded position; and releasable means for securing said linkages in said radially retracted position to permit run-in and positioning of the well tool prior to any substantial radial expansion of said linkages.

6. The apparatus of claim 5 wherein said linkages lie within the periphery of said tubular body when secured in said radially retracted position.

7. The apparatus of claim 5 further comprising means on said sleeve cooperating with said tubular body bore to define a second fluid chamber receiving fluid discharged from said first mentioned fluid chamber; and check valve means permitting free flow of fluid out of said second fluid chamber into said first mentioned fluid chamber, thereby permitting rapid radial retraction of said anti-friction means as casing bore constrictions are encountered during removal of the stabilizer apparatus from the well.

8. The apparatus of claim 1, 3, 5 or 7 wherein said temperature responsive means comprises a fusible pin securing said linkages in said radially retracted position; said pin being fusible at the temperature of the well adjacent said tubular body.

9. The method of stabilizing a downhole well tool relative to a well conduit surrounding the tool, comprising the steps of:

connecting a tubular housing in series relation to the well tool, said tubular housing carrying a plurality of peripherally spaced, radially shiftable linkages, said linkages being concurrently radially expandable to engage the wall of the surrounding well conduit;

securing said linkages in a radially retracted position by means releasable adjacent the downhole position of the tubular housing;

running the well tool downhole with said linkages in said radially retracted position, thereby minimizing frictional contact of said linkages with the conduit wall during run-in of said downhole well tool and hydraulically limiting the rate of radial expansion of said linkages.

10. The method of claim 9 wherein the step of hydraulically limiting the rate of radial expansion of said linkages does not reduce the rate of contraction of said linkages.

* * * * *